United States Patent [19]

Pierce

[11] 3,955,582

[45] May 11, 1976

[54] OBSTETRICAL TOOL FOR ANIMALS

[75] Inventor: Richard C. Pierce, Stratton, Nebr.

[73] Assignee: Vivian L. Pierce, Stratton, Nebr. ; a part interest

[22] Filed: Apr. 25, 1975

[21] Appl. No.: 571,704

[52] U.S. Cl. ..... 128/352
[51] Int. Cl.[2] ..... A61D 1/08
[58] Field of Search ..... 128/352, 353

[56] References Cited

UNITED STATES PATENTS

| | | | |
|---|---|---|---|
| 2,522,508 | 9/1950 | Frank | 128/352 |
| 2,692,600 | 10/1954 | Curyea | 128/352 |
| 2,791,219 | 5/1957 | Bowie | 128/352 |
| 2,868,207 | 1/1959 | Horst | 128/352 |
| 3,183,911 | 5/1965 | Anglemyer | 128/353 |

*Primary Examiner*—Dalton L. Truluck
*Attorney, Agent, or Firm*—Edwin L. Spangler, Jr.

[57] ABSTRACT

This invention relates to an obstetrical tool for animals and, more specifically, to an improved calf puller characterized by a crank-operated winch mechanism coupled with a pair of telescoping tubes and a system of pulleys that cooperate with one another upon actuation to nearly double the distance over which the load is drawn in comparison to the overall length of the assembly in collapsed condition. The winch itself is mounted for slidable movement along the outside tube of the telescoped pair and during the first half of the retraction stroke it migrates from a close-in position adjacent the cow's hindquarters to a remote position at the far end of the assembly in collapsed condition. During the second half of the stroke, the winch and outer telescoped tube no longer move relative to one another but instead move as a unit relative to the inside tube as they slide outwardly therealong.

10 Claims, 8 Drawing Figures

OBSTETRICAL TOOL FOR ANIMALS

For many years now the selective breeding of cattle to maximize the expensive cuts of beef has so altered the body conformation of a cow that she no longer is as suitable for calving purposes as nature intended her to be. The net result is that not infrequently she must be assisted when calving as she becomes incapable of giving birth naturally.

Range herds are seldom, if ever, attended by a veterinarian during calving as might happen with an expensive dairy herd, for example. Accordingly, it must be the rancher or ranchhands who render such assistance as may be needed in helping the cows in the herd to give birth to their calves and this operation is customarily carried out on the open range with the assistance of a well-known mechanical device commonly called a "calf puller."

Calf pullers are essentially jack mechanisms with a U-shaped yoke at one end to engage the hindquarters of the cow, a rigid post extending rearwardly from the yoke for several feet and some sort of jack mechanism movable along the post that hooks onto a chain which, in turn, is secured to the legs of the calf being born. A calf puller representative of the general type described above forms the subject matter of U.S. Pat. No. 2,522,508. Unfortunately, the prior art calf pullers of this and other types have certain shortcomings which render them somewhat ineffectual for their intended purpose.

To begin with, most calf pullers in use today are limited to a pull of a couple of feet or so and in many circumstances this is insufficient to complete the delivery of the calf or even get it to a position where the cow can finish the job herself. Using a winch mechanism in place of a jack mechanism that moves along the post solves the problem of sufficient travel provided, of course, that the post is long enough. This requires a winch drum with a rather large cable-carrying capacity which becomes bulky and cumbersome.

For the most part, the prior art calf pullers actuate with a pump handle-type lever action similar to that of the previously mentioned patent. This is even true of those using a ratchet-actuated winch drum. Unfortunately, such an action is intermittent and relatively less controllable than a crank action and, therefore, is much more likely to cause injury to the calf or the cow or both. While a lever action is advantageous from the standpoint of the mechanical advantage that can be rather easily attained, the force required of a calf puller is nowhere near that demanded of most jacks.

Ideally, therefore, a calf puller should provide for a steady long pull that can be carefully controlled so as to prevent injury to both the calf and the cow as well as causing as little trauma as possible. It should be designed for use by one person operating alone for the obvious reason that help in a situation of this type is not always available. Being a hand-held and manually-operated obstetrical tool, a compact and lightweight unit is essential.

It has now been found in accordance with the teaching of the present invention that these and other attributes of an ideal calf puller can, in fact, be realized by the simple, yet unobvious, expedient of combining the good features of both a winch and jack mechanism that moves along the post to produce an advanced obstetrical tool that can be operated by one person working all alone. The unit uses telescoping tubes and incorporates a unique block and tackle arrangement to both move the slide mechanism during the first half of the working stroke and extend the telescoped tubes during the second half. The resulting unit, while extremely compact when compared with competitive calf pullers in use today, extends upon actuation to provide ample haulage capability to deliver most, if not all calves. At the same time, the unit is easy as well as safe to use both for the operator and for the animals. It is a simple trouble-free mechanism which can be repaired with equipment found on most ranches. The use of a crank that rotates instead of a lever action provides for a steady uniform pull that is more easily regulated and, therefore, less likely to cause injury than an intermittent one.

Accordingly, it is the principal object of the present invention to provide a novel and improved calf puller.

A second object is to provide a device of the type aforementioned which provides for a continuous even pull upon the calf.

Another objective is the provision of a calf-pulling tool incorporating a unique telescoping post together with a block and tackle arrangement for extending and retracting same.

Still another object of the invention herein claimed is to provide a calf-puller in which a crank-operated winch travels along a stationary run of cable dead ended at both ends.

An additional objective of the within described invention is the provision of a highly specialized type of jack having an extra long stroke in comparison to its length prior to extension.

Further objects are to provide a calf puller which is simple to operate, lightweight, rugged, powerful, compact, easy to service, versatile, efficient, relatively inexpensive and even somewhat decorative in appearance.

Other objects will be in part apparent and in part pointed out specifically hereinafter in connection with the description of the drawings that follows, and in which.

Figure 1:
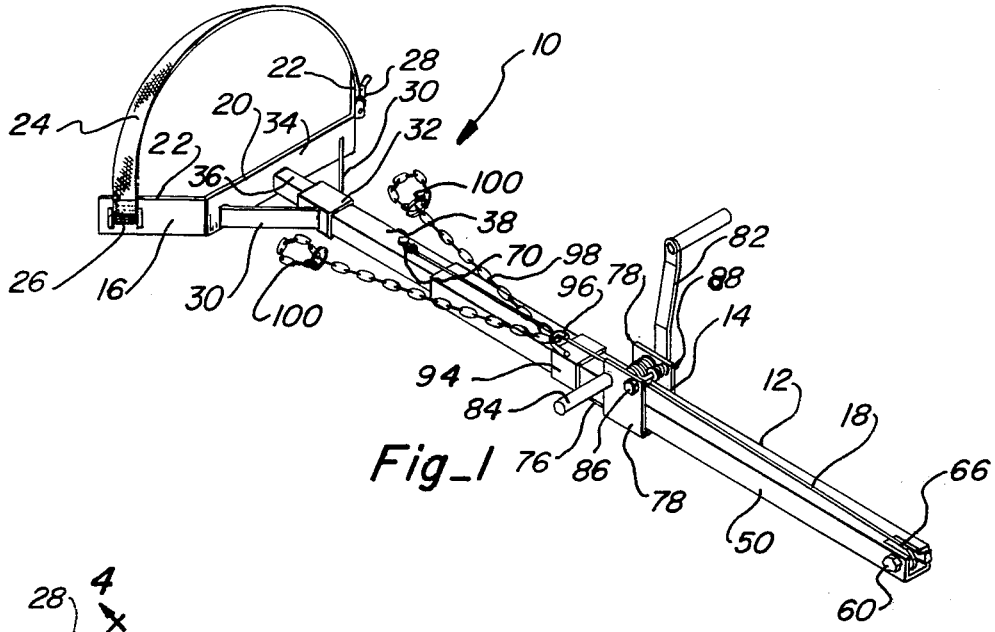
FIG. 1 is a perspective view looking down upon the calf puller from a position behind and to one side thereof.

Referring next to the drawings for a detailed description of the present invention, reference numeral 10 has been chosen to broadly designate the calf puller in its entirety while numeral 12 refers to the post portion thereof, numeral 14 its travelling winch mechanism, numeral 16 the yoke subassembly and numeral 18 the block and tackle arrangement. Starting with the yoke subassembly at the forward end, it will be seen to include a generally U-shaped member 20 fabricated from strap metal stock and adapted to fit up snug against the cow's haunches in the customary manner. The forwardly-projecting arms 22 are divergent and extend alongside the animal for a short distance to prevent her from moving sideways. Near the forward extremities of these arms, they are provided with means for securing a strap 24 thereto, one of said means comprising a conventional non-adjustable bracket 26 while the other 28 comprises an eccentric pin arrangement adapted to adjustably receive the strap end that will be described in greater detail presently in connection with FIG. 4.

Figure 5:
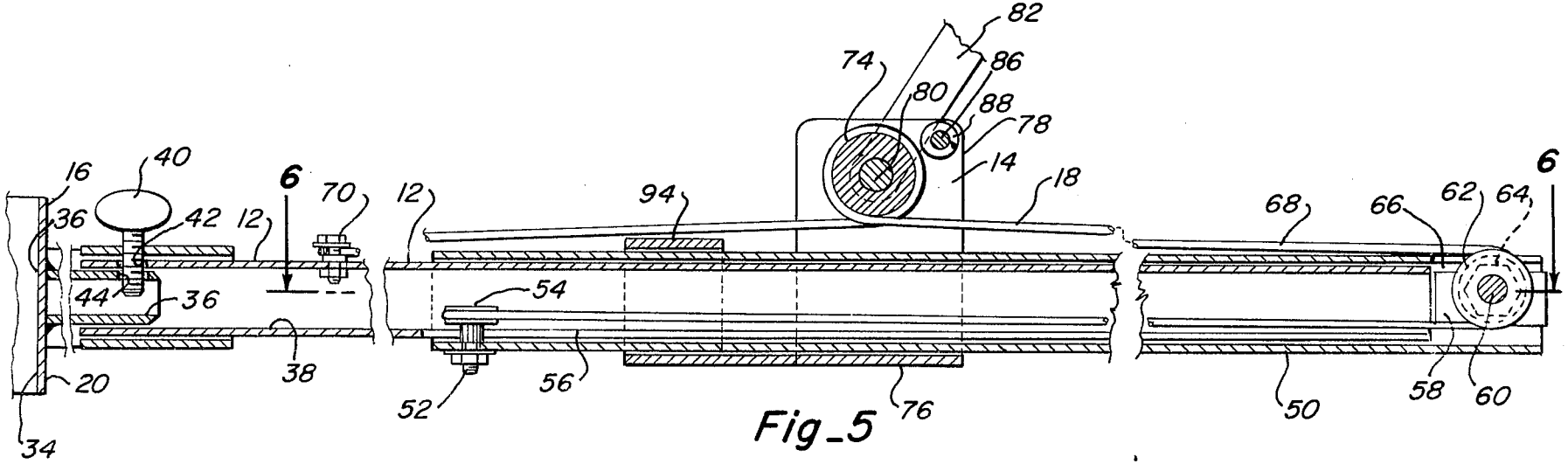
FIG. 5 is a longitudinal section to the same scale as FIGS. 3 and 4 taken along line 5—5 of FIG. 2, portions having been broken away to conserve space.
Figure 6:
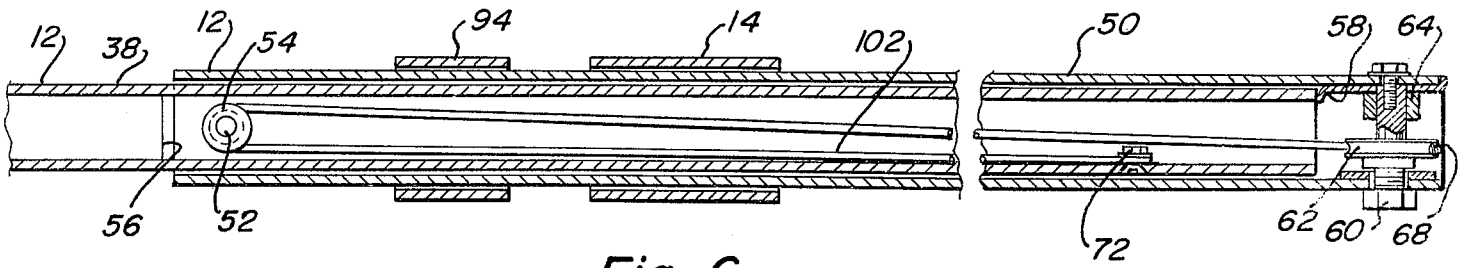
FIG. 6 is a longitudinal section to the same scale as the preceding three figures taken along line 6—6 of FIG. 5, once again having portions broken away to conserve space.
Figure 7:
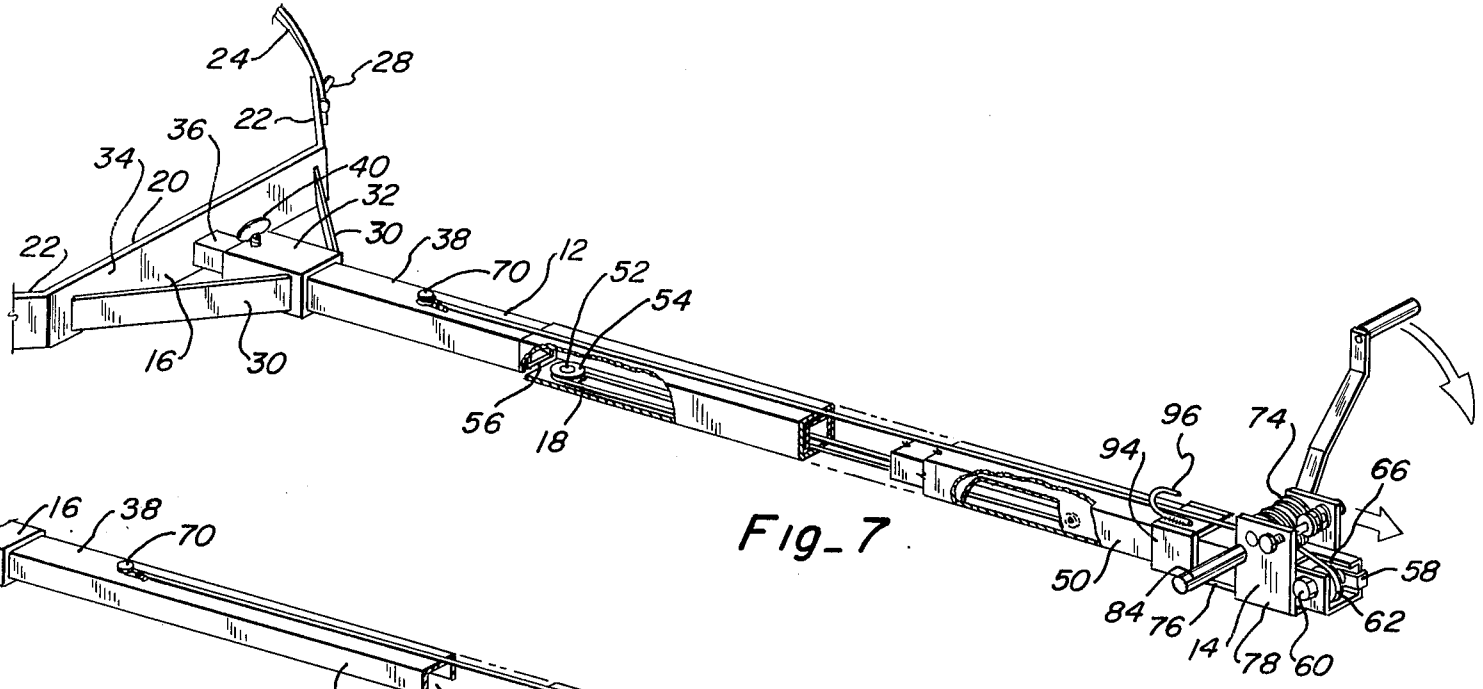
FIG. 7 is a perspective view similar to FIG. 1 except to a somewhat larger scale showing the unit partially extended, portions having been broken away to both conserve space and expose the interior construction; and, FIG. 8 is a perspective view like FIG. 7 and to the same scale showing the post fully extended.
Figure 8:
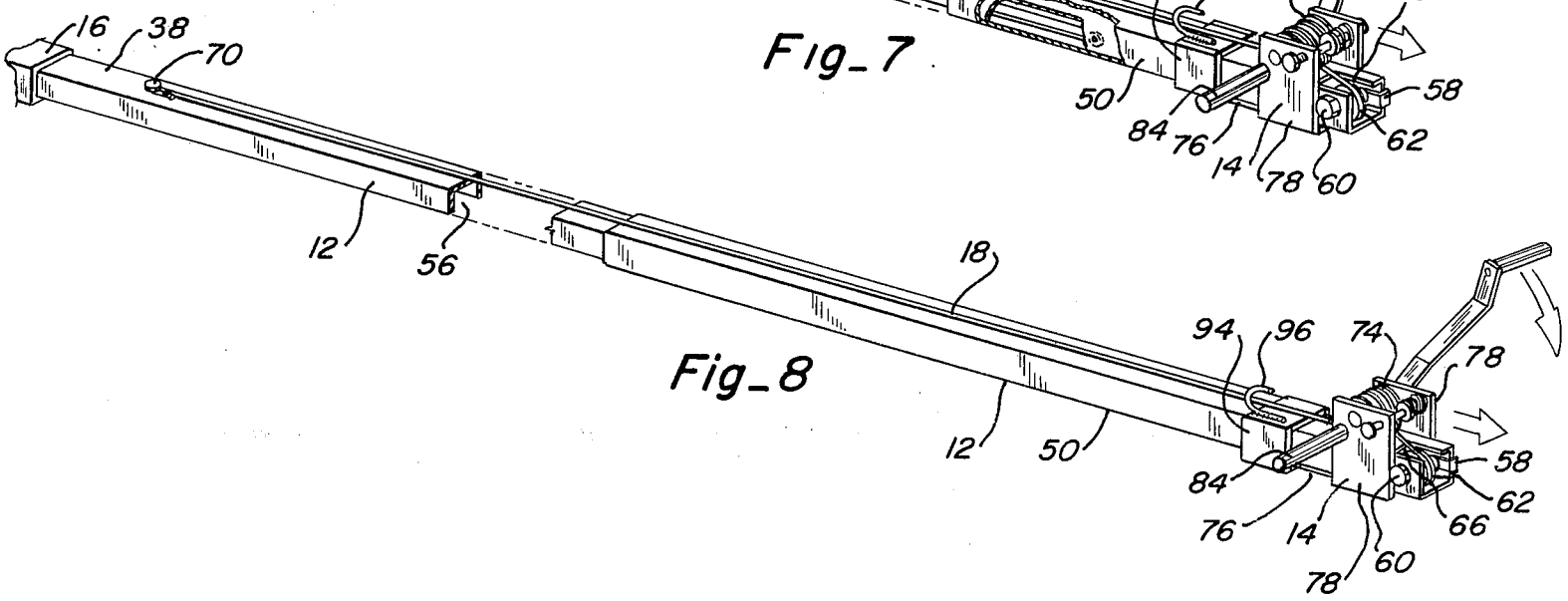

Diagonally-disposed divergent braces 30 fasten square sleeve 32 to the rear end of the U-shaped element 20 intermediate its side margins and perpendicular to its crosspiece 34. In the particular form shown, the front end of this sleeve is partially plugged by a square insert 36 depending from crosspiece 34 and projecting rearwardly therefrom in perpendicular relation into this sleeve so as to leave a gap therebetween of a width sufficient to receive the front end of inner telescoping element 38 as shown in FIG. 5 to which detailed reference will now be made. Sleeve 32 is provided with a lock screw 40 threadedly mounted therein for movement into aligned apertures 42 and 44 in the inner telescoping member 38 and insert 36 that detachably fastens the yoke subassembly to the post 12 in assembled relation.

Looking briefly at FIG. 1, it will be seen that belt 24 arches up over the cow's back and in this position supports the front end of the puller. Adjusting the length of the belt by means of eccentric pin 28 allows the operator to place the post at the proper level on the cow's hindquarters. The newborn calf (not shown) will, of course, pass through the loop defined by the arched belt and the U-shaped member 20 from which it depends.

Figure 4:
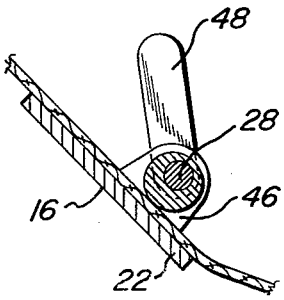
FIG. 4 is a fragmentary section to the same scale as FIG. 3 taken along line 4—4 of FIG. 2.

In FIG. 4 it can be seen that eccentric pin 28 is mounted for rotation between a pair of ears 46, the axis of rotation being off center so that said pin is effective to wedge the belt tightly against the opposed surface of arm 22 over which it rides. A handle 48 on the end of the pin is used to manually rotate it. The resulting adjustable connector, while by no means novel, does facilitate quickly setting the belt to the proper length.

Having thus completed the description of the yoke subassembly 16, the attention is next directed to FIGS. 3 and 5–8, inclusive, for a detailed description of the telescoping post 12. The inner telescoping element 38 comprises a hollow box beam with a square cross section, the outside dimensions of which allow it to telescope freely into the outer telescoping element 50 which is also a box beam of square cross section. An upstanding shaft 52 is mounted in the forward end of the outer element 50 upon which a small pulley 54 is mounted for rotation about the vertical axis defined by this shaft. In order for the inner member 38 to telescope into the outer element 50 past this pulley and its shaft, the bottom wall of the inner member must be removed to produce slot 56. This slot encompasses the entire portion of the inner element that telescopes inside the outer one when in fully-retracted position. Adjacent the rear end of the outer element is provided a limit stop 58 positioned to engage the corresponding end of the inner element and limit its degree of penetration into the outer element.

Extending transversely of the outer element adjacent its rear end is a shaft 60 upon which a second pulley 62 is mounted for rotation about the axis defined by the latter. A nut 64 threaded onto this shaft is employed to hold the limit stop 58 in place against the sidewall as shown. The top wall of outer element 50 is provided with a slot 66 at its rear end positioned to receive the pulley 62 and let cable 68 of block and tackle 18 emerge from inside the telescoping post subassembly onto the surface thereof.

Before detailing the winch mechanism, reference will be made briefly to all but FIG. 4 to complete the description of the block and tackle mechanism 18, substantial portions of which have already been described. Cable 68 has one free end thereof dead ended on the portion of inner telescoping element 38 that always projects forwardly beyond the front end of the outer element 50 in all relative positions of the two. An anchor member 70 is provided on the top wall. A similar anchor element 72 is mounted on the left inside wall of this same inner telescoping element as viewed from the rear end of the puller looking forwardly. The opposite free end of cable 68 is anchored at this point.

Cable 68 runs forwardly from anchor 72 inside inner element 38, around pulley 54 and rearwardly to pulley 62. It then passes underneath pulley 62 and up through slot 66 onto the exterior of the telescoping subassembly. From pulley 62 it, once again, runs forwardly along the top wall of the outer element to the drum 74 of crank-operated travelling winch mechanism 14. The cable makes several turns around the winch drum before leaving it and running on forward to be secured at anchor 70. Enough cable must be wound upon drum 74 to accommodate the movement of the telescoping post subassembly 12 from its fully-retracted position shown in FIGS. 1 and 2 to the fully extended position of FIG. 8.

Figure 2:
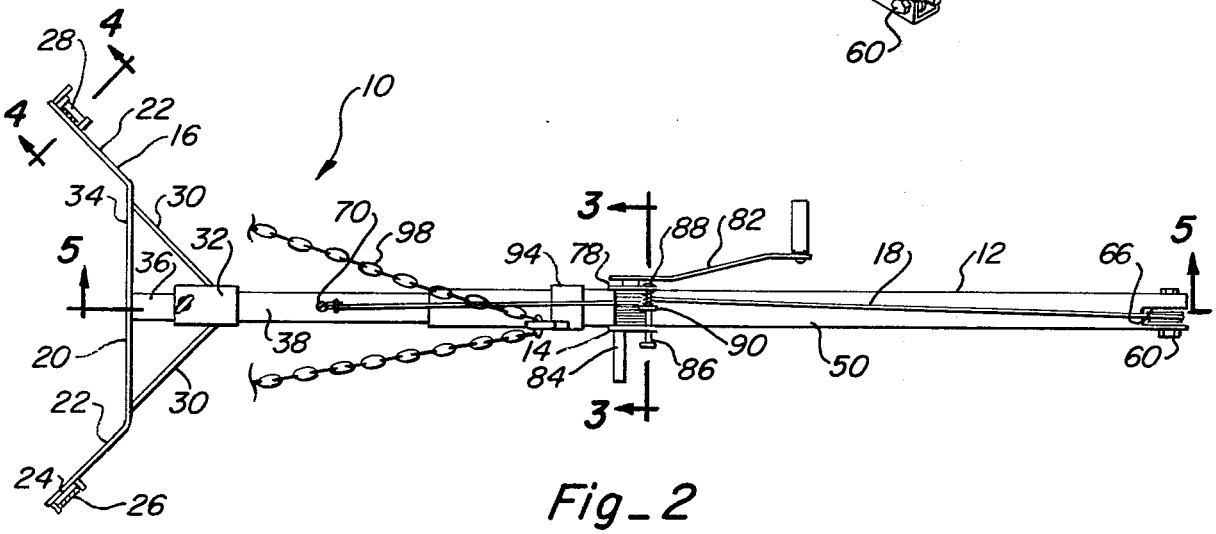
FIG. 2 is a top plan view.
Figure 3:
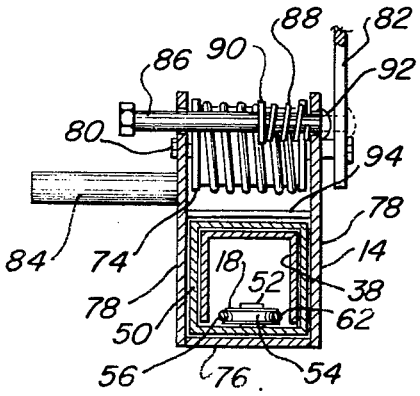
FIG. 3 is a transverse section to an enlarged scale taken along line 3—3 of FIG. 2, certain portions having been broken away to conserve space.

Winch mechanism 14 is, like the block and tackle mechanism, revealed in all figures of the drawings except FIG. 4. A U-shaped frame consisting of a bottom wall 76 and tranversely-spaced parallel side plates 78 cradle the outer telescoping element 50 and receive same loosely enough to slide therealong. These side plates project a considerable distance above the top wall of the outer telescoping element where they receive transverse crankshaft 80 non-rotatably mounting the winch drum 74 and carrying handcrank 82 on one end thereof. Handcrank 82 is shown on the righthand side of the winch as the operator faces forwardly. Projecting out to the left of the frame is a fixed handle 84 to be grasped with the lefthand while turning the crank with the right. A stop pin 86 is mounted between the side plates 78 of the winch frame for reciprocating movement between the retracted inoperative position shown in FIGS. 2, 3, 7 and 8 to the extended crank-blocking position of FIG. 1. Compression spring 88 mounted on the pin 86 between right side plate 78 and washer 90 on the pin normally biases the latter into retracted position where the head 92 comes to rest against said right side plate as shown in FIG. 3. Upon movement of the pin to the right to compress spring 88, head 92 will lock behind crank 82 in the well-known manner. Pin 86 is in position for actuation by the thumb of the lefthand while holding onto handle 84. Crank 82 and the winch drum are, of course, fixedly mounted upon winch shaft 80 for conjoint rotation.

Spaced forwardly of the winch frame and connected thereto by common bottom wall 76 is a slide 94 in the shape of a square tube sized to fit over the outer telescoping element 50 and slide therealong in conjunction with the winch and its frame. The top wall of the slide carries a rearwardly-opening hook 96 onto which the obstetrical chain 98 is hooked as shown in FIGS. 1 and 2. This hook is preferably displaced over near one edge or the other of the slide as shown to clear cable 68 as it winds on and off the winch drum moving along therebehind. The common bottom wall connecting the winch frame and slide along with the enclosed top of the latter cooperate to keep the subassembly thus formed tracking properly as it moves to and fro along the post.

The pre-operative position of the unit is that shown in FIG. 1 where the telescoping post is fully retracted, the winch and slide are all the way forward and the latch pin 88 is extended to lock the crank 82 against rotaton. At this point, a standard obstetrical chain 98 has the ends thereof formed into loops 100 which are secured around the forelegs of the calf while the rest of its body remains in the cow's birth canal. Next, the strap 24 is run up over her rump and secured behind eccentric pin 28 after being adjusted to the proper length. Then the medial portion of chain 98 is hooked behind hook 96 and latch pin 86 released to its normally-retracted position preparatory to commencement of the pulling operation.

With everything thus attached and ready, the operator assumes a position either behind or alongside the post, grabbing the crank 82 with the righthand and stationary handle 84 with the left. As the crank is turned in the direction of the arrows in FIGS. 7 and 8, the winch subassembly 14 including slide 94 and the chain 98 attached thereto will move steadily rearward along post 12 until they reach the rear end thereof, whereupon, the winch frame will engage the shaft 60 mounting pulley 66 and be stopped thereby. Up to this point, the telescoped post has remained fully retracted. From this point on, however, continued rotation of the crank in the same direction will act to foreshorten the portion 102 of the cable (FIGS. 5 and 6) running inside the post between pulley 54 and anchor 72. As that portion of the cable behind the winch winds onto the winch drum without unwinding a corresponding amount off as occurred all the while the winch subassembly was travelling rearwardly along the post, pulley 54 inside the outer telescoped member 50 will be pulled steadily rearward toward anchor 72 bringing with it the outer telescoped element 50 and causing the post 12 to assume the pulley extended relation shown in FIG. 8. As post 12 extends and its outer element 50 moves rearwardly, it carries with it the winch subassembly including the winch, slide, obstetrical chain and, hopefully, the calf as well.

What is claimed is:

1. An obstetrical device for assisting cows in giving birth to their calves which comprises: a rigid generally U-shaped yoke effective to bridge the flanks of a cow and confine same against lateral movement; strap means attached to opposite ends of the yoke adapted to arch over the cow's back and support said yoke in position beneath the cow's birth canal; an inner tubular element extending rearwardly from a point of attachment intermediate the ends of the yoke, said element including a slot in the underside thereof opening onto its rear end; an outer tubular element telescoped over the inner tubular element and cooperating therewith to define a rigid post movable between a retracted and an extended position; a first pulley mounted in the rear end of the outer tubular element for rotation about a transverse axis; a second pulley mounted within the bottom of the outer tubular element for rotation within the slot in the inner tubular element about a vertical axis; a winch frame including a sleeve mounted on the outer tubular element for longitudinal slidable movement between the ends thereof, said frame including means for attaching an obstetrical chain thereto and a pair of upstanding transversely spaced supports; a crank-operated winch drum mounted between the spaced supports of the winch frame for rotational movement about a transverse axis; and, a winch cable wound upon the winch drum having one end anchored at a point forward of the outer tubular element that remains fixed with respect to the yoke and the other end anchored inside the outer tubular element adjacent the rear end thereof, the section of said cable lying between the winch drum and the anchor point within the outer tubular element being reaved rearwardly over the first pulley then forwardly inside the post around the second pulley and finally forwardly again to said outer tubular element anchor point, said winch when located at the rear end of the post with the latter in extended position being operative upon actuation in a selected direction to first retract said post and then travel to the forward end thereof, and said winch being operative when at the forward end of the post upon actuation in the opposite direction to first travel to the rear end thereof and subsequently extend same thereby drawing a calf attached to the obstetrical chain from the birth canal of the cow.

2. The obstetrical device as set forth in claim 1 which includes: first stop means located at the rear end of the outer tubular element in position to engage and limit the rearward movement of the winch frame therealong.

3. The obstetrical device as set forth in claim 1 which includes: a second stop means within the outer tubular element located forwardly of the first pulley and in position to engage the rear end of the inner tubular element upon telescoping movement of said outer tubular element into fully retracted position.

4. The obstetrical device as set forth in claim 1 which includes: third stop means carried by the winch frame for movement between a retracted inoperative position and an extended operative one engaging the crank-operated winch drum so as to prevent rotation thereof in either direction over a full revolution.

5. The obstetrical device as set forth in claim 1 in which: both the inner and outer tubular elements and the sleeve of the winch frame have rectangular cross sections effective to prevent relative rotational movement therebetween.

6. The obstetrical device as set forth in claim 1 in which: the means for attaching an obstetrical chain to the winch frame comprises a rearwardly-opening hook mounted forwardly of the winch drum.

7. The obstetrical device as set forth in claim 1 in which: the rear end of the outer tubular element is slotted to receive the first pulley and the cable reaved thereover.

8. The obstetrical device as set forth in claim 4 which includes spring means interconnecting the frame and stop means operative to normally bias the latter into its retracted position.

9. The obstetrical device as set forth in claim 6 in which: the hook is displaced toward one side margin of the winch frame out of the way of the winch cable moving onto the winch drum.

10. The obstetrical device as set forth in claim 7 in which: the first pulley is mounted for rotation in position such that the upper portion thereof emerges onto the exterior of the outer tubular element through said slot in the rear end of the latter.

* * * * *